US008109216B2

(12) United States Patent
Nono et al.

(10) Patent No.: US 8,109,216 B2
(45) Date of Patent: Feb. 7, 2012

(54) LIQUID STORAGE AND DISPENSING DEVICE AND METHOD THEREOF

(76) Inventors: Mirna Nono, Granada Hills, CA (US); Fadi Nono, Granada Hills, CA (US)

( * ) Notice: Subject to any disclaimer, the term of this patent is extended or adjusted under 35 U.S.C. 154(b) by 777 days.

(21) Appl. No.: 12/116,191

(22) Filed: May 6, 2008

(65) Prior Publication Data

US 2009/0278009 A1 Nov. 12, 2009

(51) Int. Cl.
*A47B 11/00* (2006.01)

(52) U.S. Cl. ..... 108/110; 108/107; 108/147.11; 312/348.3; 206/425; 206/561; 220/544; 220/549

(58) Field of Classification Search ..... 312/348.3, 312/350, 294; 211/184; 108/106, 107, 110, 108/147.11, 147.16, 147.17; 248/244; 206/425, 206/561; 220/528, 544, 549, 543
See application file for complete search history.

(56) References Cited

U.S. PATENT DOCUMENTS

| | | | | | |
|---|---|---|---|---|---|
| 947,561 | A * | 1/1910 | Van Clief Ricker | 220/533 |
| 963,919 | A * | 7/1910 | Mitchell | 40/383 |
| 993,406 | A * | 5/1911 | Probert et al. | 220/533 |
| 1,404,632 | A * | 1/1922 | Morgan | 220/529 |
| 1,416,287 | A * | 5/1922 | Harrah | 220/533 |
| 1,416,288 | A * | 5/1922 | Harrah | 220/533 |
| 1,416,289 | A * | 5/1922 | Harrah | 220/546 |
| 1,600,779 | A * | 9/1926 | Steele | 220/533 |
| D152,653 | S * | 2/1949 | Rinehart | D3/284 |
| 2,610,759 | A * | 9/1952 | Slade | 220/533 |
| 2,966,041 | A * | 12/1960 | Zearfoss, Jr. et al. | 62/60 |
| 3,129,838 | A * | 4/1964 | Wormer, III | 220/510 |
| 3,353,704 | A * | 11/1967 | Belcher et al. | 220/510 |
| 3,410,445 | A * | 11/1968 | Pilley | 220/533 |
| 4,123,128 | A * | 10/1978 | Abele | 312/244 |
| 4,538,737 | A * | 9/1985 | Delaney | 211/71.01 |
| 4,565,073 | A * | 1/1986 | Lavender | 62/373 |
| 4,927,016 | A * | 5/1990 | Fuller | 206/315.11 |
| 4,932,548 | A * | 6/1990 | Bensinger | 220/552 |
| D338,555 | S * | 8/1993 | Olson | D3/260 |
| 5,396,996 | A * | 3/1995 | Box | 211/46 |
| 5,443,160 | A * | 8/1995 | Tortorella et al. | 206/561 |
| 6,030,059 | A * | 2/2000 | Stravitz | 312/9.47 |
| 6,203,129 | B1 * | 3/2001 | Kupferschmid | 312/9.48 |
| 6,684,646 | B2 * | 2/2004 | Voute et al. | 62/66 |
| 2002/0033199 | A1 * | 3/2002 | Lafond | 141/10 |

* cited by examiner

*Primary Examiner* — Darnell Jayne
*Assistant Examiner* — Kimberley S Wright
(74) *Attorney, Agent, or Firm* — James A. Italia; Italia IP

(57) ABSTRACT

An apparatus for storing fluid containing bags comprising a shelf having a bag-supporting surface, and a pair of laterally extending projections. The device includes a pair of opposed sidewalls each comprising an inner surface, and a longitudinal groove for receiving one of said projections. The groove is disposed in the inner surface. A first support for supporting one of the projections in a first shelf position is disposed within the groove, and a second support for supporting one of the projections in a second shelf position is disposed within the groove. The shelf is disposed between the sidewalls such that each of the projections is disposed within a corresponding groove. The shelf is movable from the first shelf position wherein each of the projections is supported by a corresponding first support and the second shelf position wherein each of the projections is supported by a corresponding second support.

8 Claims, 3 Drawing Sheets

LIQUID STORAGE AND DISPENSING DEVICE AND METHOD THEREOF

BACKGROUND

This application relates generally to the storage of liquid. More specifically, this application relates to a liquid storage and dispensing device and method thereof.

SUMMARY

Breast milk is widely recognized as a superior form of nutrition for newborns and infants. However, storage of breast milk for future use is problematic as breast milk lacks preservatives to give it a longer shelf life. Typically, breast milk is stored in bottles and refrigerated or frozen and thawed and/or warmed when it is needed. Bottles, however, are relatively bulky and consume valuable space in a refrigerator and/or freezer. In addition, without proper labeling, it is difficult to determine how long any given bottle has been in storage. Therefore, there is a significant need for a breast milk storage device that is efficient in terms of storage space and determining how long any given unit of breast milk has been in storage for such that the units that have been in storage the longest are the ones first used.

This application discloses a liquid storage device that is economical to produce, of simple construction and capable of mass production, but also capable of providing a user a suitable means to store breast milk and other liquids.

In particular, this application discloses an apparatus for storing fluid containing bags comprising a shelf having a bag-supporting surface, and a pair of laterally extending projections. The device also includes a pair of opposed sidewalls with each sidewall comprising an inner surface, and a longitudinal groove for receiving one of said projections. The groove is disposed in the inner surface. A first support for supporting one of the projections in a first shelf position is disposed within said groove, and a second support for supporting one of the projections in a second shelf position is spaced apart from the first support and disposed within the groove. The shelf is disposed between the sidewalls such that each of the projections is disposed within a corresponding groove. The shelf is movable from the first shelf position wherein each of the projections is supported by a corresponding first support and the second shelf position wherein each of the projections is supported by a corresponding second support.

This application also discloses an apparatus for storing fluid containing bags comprising a shelf having a bag-supporting surface, and a pair of laterally extending projections. The device also includes a pair of opposed horizontally-extending sidewalls with each sidewall comprising an inner surface, a longitudinal groove for receiving one of said projections. The groove is disposed in the inner surface. A first support for supporting one of the projections in a first shelf position is disposed within said groove, and a second support for supporting one of the projections in a second shelf position is spaced apart from the first support and disposed within the groove. In addition, a rear wall is disposed between the sidewalls. The shelf is disposed between the sidewalls such that each of the projections is disposed within a corresponding groove. The shelf is movable from the first shelf position wherein each of the projections is supported by a corresponding first support and the second shelf position wherein each of the projections is supported by a corresponding second support.

Finally, this application discloses a method for storing fluid containing bags comprising the steps of: providing a pair of opposed sidewalls; providing a first shelf between said sidewalls; supporting said first shelf in a first shelf position; placing a first fluid containing bag on said first shelf; freezing said first fluid containing bag; moving said first shelf to a second shelf position; supporting said first shelf in said second shelf position; providing a second shelf between said sidewalls; supporting said second shelf in said first shelf position; placing a second fluid containing bag on said second shelf; freezing said second fluid containing bag; and removing said first fluid containing bag from said first shelf.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
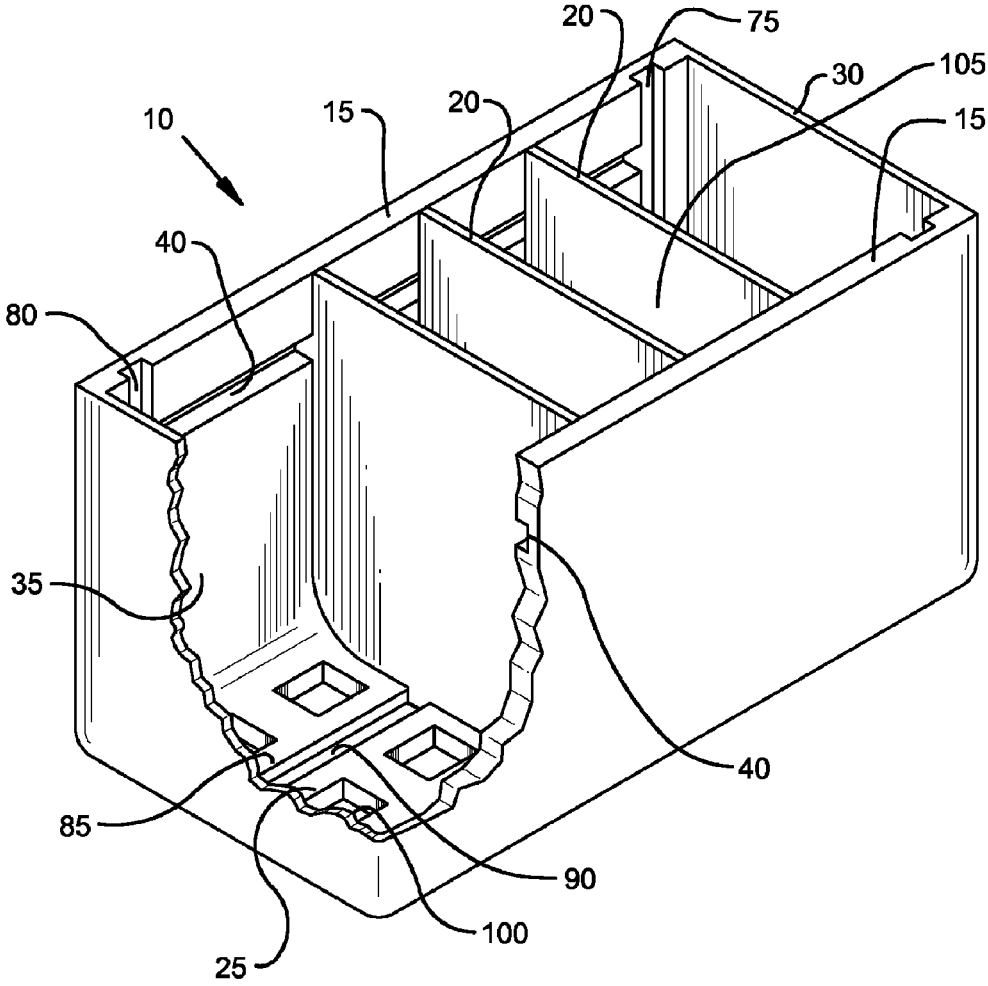
FIG. 1 is a perspective view of a first embodiment of a liquid storage and dispensing device showing the device in a horizontal orientation.
Figure 2:
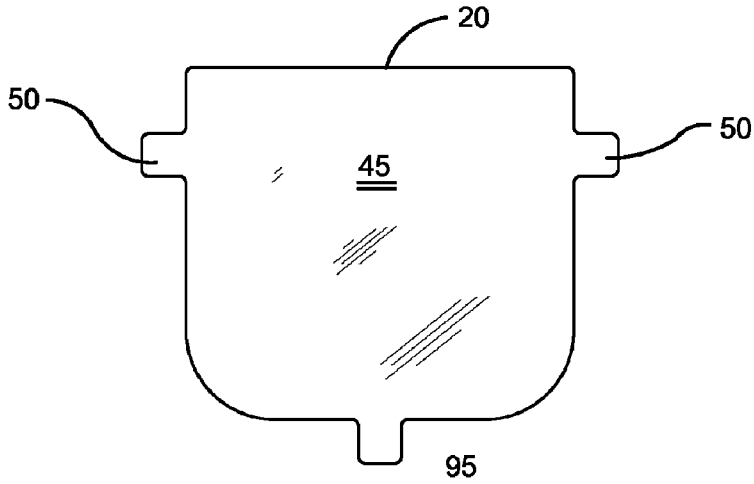
FIG. 2 is a plan view of a shelf.

While the present liquid storage and dispensing device is described with reference to several illustrative embodiments described herein, it should be clear that the present invention should not be limited to such embodiments. Therefore, the description of the embodiments provided herein is illustrative of the present invention and should not limit the scope of the invention as claimed. In addition, while following description references breast milk containing bags, it will be appreciated that the invention may be serve to store and dispense any fluid containing bags and is not limited solely to breast milk.

Referring now to FIGS. 1-5, a first embodiment of a liquid storage and dispensing device 10 is shown. The device 10 may be constructed from any sufficiently durable and resilient material such as metal, polymer, composite, etc. The device 10 includes a pair of opposed sidewalls 15, one or more shelves 20, a rear wall 25, and a pair of end walls 30. Each shelf 20 includes a bag-supporting surface 45 and a pair of laterally extending projections 50. As will be discussed further below, each shelf 20 is operable to support a breast milk bag 60 atop the supporting surface 45, or support a breast milk bag 60 in the space 105 between two adjacent shelves 30. The breast milk bags 60 are well known in the art and the device 10 is operable with any suitably configured bag 60. In addition, each shelf 20 may include a rearwardly extending projection 65.

Figure 3:
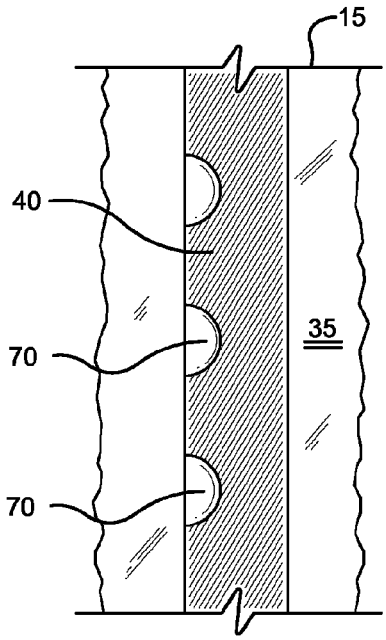
FIG. 3 is a partial plan view of a groove.
Figure 4:
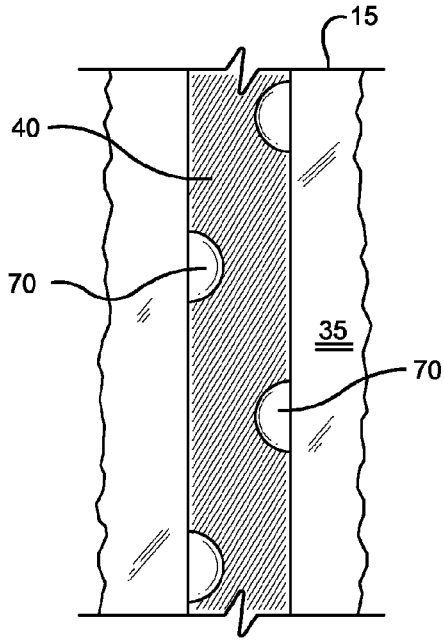
FIG. 4 is a partial plan view of an alternative groove.

Each sidewall 15 includes an inner surface 35 with a longitudinal groove 40 therein. The longitudinal groove 40 is sized so as to slidingly receive a corresponding lateral projection 50 from each shelf 20 therein. In addition, as best shown in FIGS. 3 and 4, the longitudinal groove 40 may include a plurality of shelf supports 70 therein. As shown in FIG. 3, the supports 70 may be on the same side of the groove 40. Alternatively, as best shown in FIG. 4, the supports 70 may alternate between each side of the groove 40. The supports 70 are operable to support a shelf 20 so that the shelf 20 may support a breast milk bag 60 as described above. In addition, when sufficient force is placed on a shelf 20, each support 70 is operable to cause a corresponding projection 50 of a shelf 20 to flex thereby allowing the shelf 20 to slide past the support 70 and slide within the groove 40 to the next support 70 in the groove 40. In the illustrative embodiment, each support 70 has a semi-circular profile; however, it will be appreciated that the supports 70 may have any suitably shaped profile, including but not limited to, rectangular, square, triangular, etc.

In addition, each sidewall 15 may include an entrance slot 75 in communication with the groove 40 whereby a corresponding projection 50 of a shelf 20 may be received by the entrance slot 75 and moved into the groove 40 such that the shelf 20 is received between the sidewalls 15. Also, each sidewall 15 may include an exit slot 80 in communication with the groove 40 and operable to allow a corresponding projection 50 of a shelf 20 to pass through in order to be removed from the groove 40 thereby allowing the shelf 20 to be removed from between the sidewalls 15. As seen in FIG. 1, the entrance slot 75 is spaced apart from the exit slot 80, each located near a respective end of the sidewalls 15.

The device 10 may also include a rear wall 25 that extends between the sidewalls 15. The rear wall 25 includes an inner surface 85. The inner surface 85 may include a longitudinal groove 90 therein wherein the groove 90 is sized to slidingly receive a rearwardly extending projection 95 of a corresponding shelf 20. The groove 90 may include a plurality of shelf supports (not shown) therein, which are configured and operate in conjunction with the rearwardly extending projection 95 similar to that of the sidewall groove 40 and lateral projections 50. The rear wall 25 may also include one or more apertures 100 whereby a user may press on a breast milk bag 60 in order to loosen it from a shelf 20 in the event the bag 60 becomes frozen to a shelf 20. The device 10 may also include a pair of end walls 30 where each end wall 30 is disposed at one end of the pair of sidewalls 15.

Figure 5:
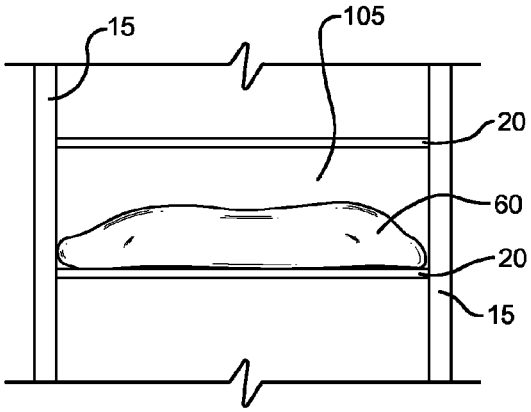
FIG. 5 is a partial plan view showing the device of FIG. 1 in a vertical orientation.
Figure 6:
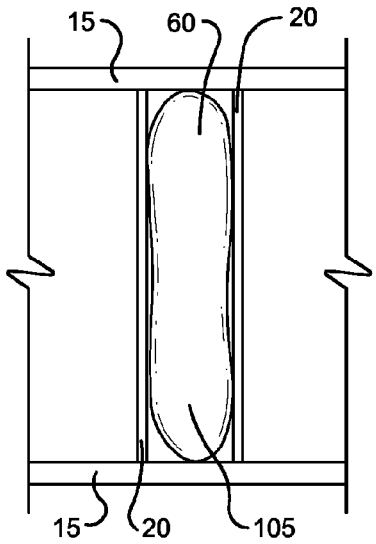
FIG. 6 is a partial plan view showing the device of FIG. 1 in a horizontal orientation.

In the illustrative embodiment, the device 10 may generally operate in two basic orientations. First, as best shown in FIG. 5, the device 10 may be oriented in a vertical fashion wherein the sidewalls 20 extend upwardly in a generally vertical direction such that the shelves 20 are in a generally horizontal orientation. In this arrangement, gravity acts on the breast milk bags 60 to cause them to rest substantially flat on a corresponding bag-supporting surface 45 of a shelf 20. Advantageously, this allows for a greater breast milk bag 60 surface area which aids in faster and more uniform freezing and defrosting. In the second orientation, as best shown in FIGS. 1 and 6, the device may be oriented in a horizontal fashion wherein the sidewalls 20 extend laterally in a generally horizontal direction such that the shelves 20 are in a generally vertical orientation. In this arrangement, the shelves 20 are spaced from one another such that when a breast milk bag 60 is disposed in a gap 105 between two adjacent shelves 20, the shelves 20 act to press the bag 60 substantially flat thereby providing the same advantages previously discussed. In the horizontal orientation, a user may put a slight compressive force on one shelf 20 in order to compress the bag 60 between the shelves 20 thereby assuring that the bag 60 is maintained substantially flat therebetween. Nevertheless, it will be appreciated that the shelves 20 and sidewalls 15 may be at any suitable angle with respect to one another.

In use, the device may be stored in a freezer or moved into a freezer once one or more breast milk bags 60 are ready to be frozen. First, a shelf 20 is disposed between the sidewalls 15 by passing the lateral projections 50 through the entrance slots 75 and into corresponding sidewall grooves 40. In addition, the rearwardly extending projection 65 is disposed within the rear wall groove 90. The shelf 20 may then be moved within the grooves 40, 90 to a first set of supports 70 in the grooves 40, 90 on top of which the projections 50, 65 rest. The shelf 20 may then support a first breast milk bag 60. Once a second breast milk bag 60 is ready for storage, the first breast milk bag 60 and corresponding shelf 20 are forced to the next set of supports 70.

A second shelf 20 may then be disposed between the sidewalls 15 in the same manner as previously discussed. If the device 10 is placed in the horizontal orientation as described above, the second shelf 20 may be moved towards the first shelf 20 such that the first breast milk bag 60 is supported in a substantially flat orientation in the gap 105 between the first and second shelves 20. Alternatively, in the vertical orientation as described above, each shelf 20 may support a breast milk bag 60 atop the bag-supporting surface 45. The second shelf 20 may then support a second breast milk bag 60. If the device 10 is in the horizontal orientation, a third shelf 20 may be disposed between the sidewalls 15 and moved towards the second shelf 20 such that the second breast milk bag 60 may be supported in a substantially flat orientation in the gap 105 between the second and third shelves 20. Once the breast milk in the breast milk bags 60 is frozen, they may be removed from the device 10 and thawed for use. In the illustrative embodiment, the first breast milk bag 60 placed within the device 10 will be the first bag 60 removed from the device 10 for use (i.e. "first in, first out"). Also, while the forgoing description discussed only two breast milk containing bags 60, it will be appreciated that any suitable number of breast milk bags 60 and/or any suitable number of shelves 20 may be employed and remain within the scope of the present invention.

Figure 7:
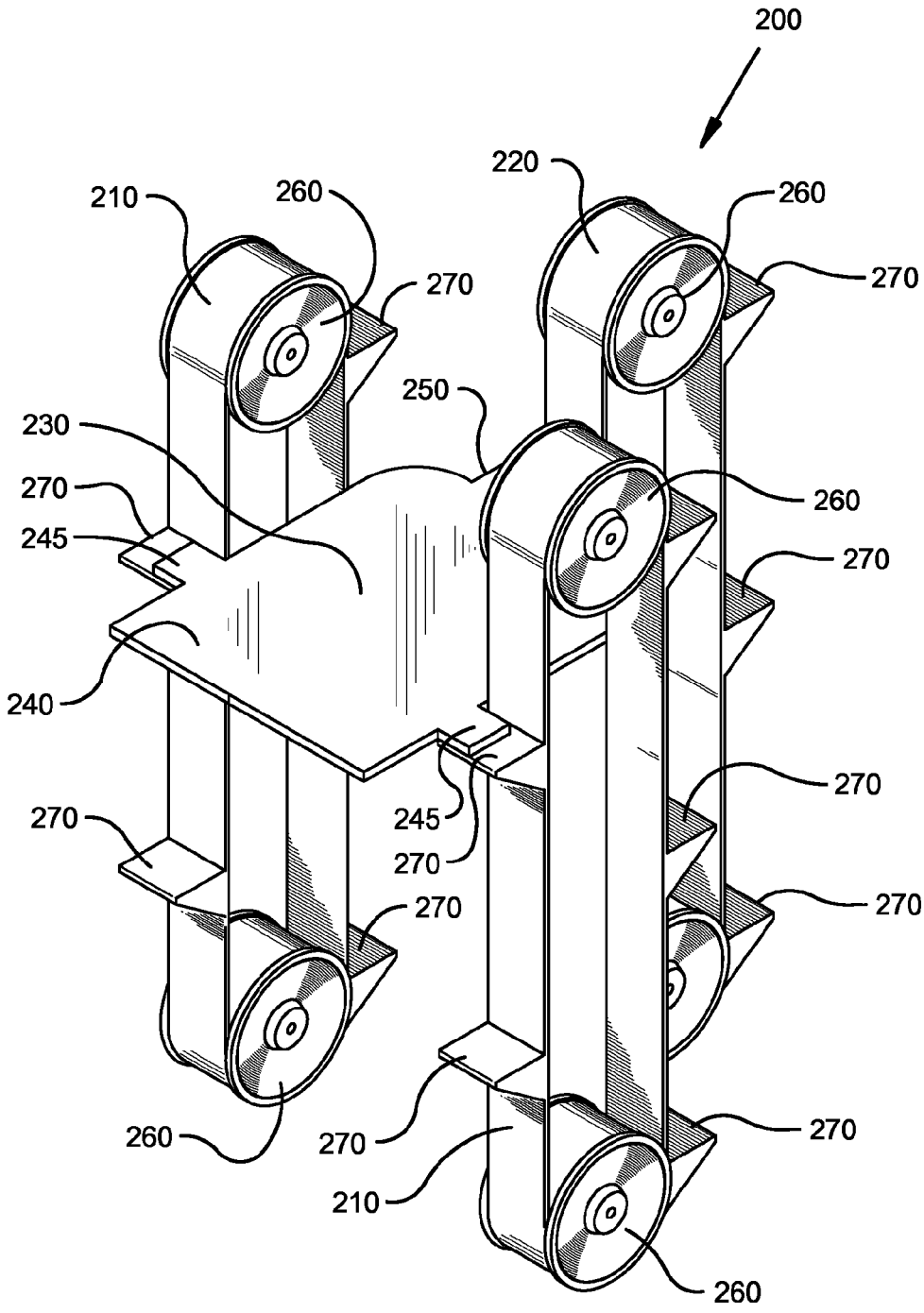
FIG. 7 is a perspective view of a second embodiment of a liquid storage and dispensing device.

Referring now to FIG. 7, a second embodiment of a liquid storage and dispensing device 200 is shown. The device 200 includes a pair of opposed side belts 210, a rear belt 220 and one or more shelves 230. Each shelf 230 includes a bag-supporting surface 240 and a pair of laterally extending projections 245. In addition, each shelf 230 is operable to support a breast milk bag 60 atop the supporting surface 240, or support a breast milk bag 60 in the space between two adjacent shelves 230. Also, each shelf 230 may include a rearwardly extending projection 250.

Each belt 210, 220 rotates about a pair of spools 260 which are rotatably supported within a housing (not shown). It should be appreciated that the belts may rest within corresponding grooves (not shown) in the housing, and that the housing may also have entrance slots and exit slots similar to the forgoing illustrative embodiment whereby the shelves 230 may be easily inserted into and/or removed from the groove. In addition, each belt 210, 220 includes a plurality of supports 270. Each support 270 is operable to support a corresponding projection 245, 250 of a shelf 230.

In use, a shelf 230 is inserted between the belts 210, 220 such that each projection 245,250 is received by a corresponding support 270. The shelf 230 may then support a first breast milk bag 60. The belts 210, 220 may then be rotated by pressing downwardly on the first shelf 230 whereby the first shelf 230 is moved to a second shelf position, and whereby any other shelf 230 in the device 200 is moved to a subsequent shelf position. A second shelf 230 is then inserted between the belts 210, 220 such that each projection 245,250 is received by a corresponding support 270 and such that the second shelf 230 is above the first shelf 230. The second shelf 230 may then support a second milk bag 60.

Once the breast milk in the breast milk bags 60 is frozen, they may be removed from the device 200 and thawed for use. In the illustrative embodiment, the first breast milk bag 60 placed within the device 200 will be the first bag 60 removed from the device 200 for use (i.e. "first in, first out"). Also, while the forgoing description discussed only two breast milk containing bags 60, it will be appreciated that any suitable number of breast milk bags 60 and/or any suitable number of shelves 230 may be employed and remain within the scope of the present invention.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. An apparatus for storing fluid containing bags comprising:

a shelf comprising a bag-supporting surface, and a pair of laterally extending projections which can flex; and a pair of opposed sidewalls, each sidewall comprising an inner surface, a longitudinal groove for receiving one of said laterally extending projections, and an entrance slot, each entrance slot in communication with a corresponding longitudinal groove of one of said sidewalls, each of said entrance slots operable to permit one of said laterally extending projections to pass into said corresponding longitudinal groove, and each sidewall further comprising an exit slot, each exit slot in communication with a corresponding longitudinal groove of one of said sidewalls, each of said exit slots operable to permit one of said laterally extending projections to pass out of said corresponding longitudinal groove, and wherein said entrance slots are spaced apart from said exit slots, said longitudinal groove disposed in said inner surface, a first support for supporting one of said laterally extending projections in a first shelf position, said first support disposed within each said longitudinal groove, and a second support for supporting one of said laterally extending projections in a second shelf position, said second support spaced apart from said first support and disposed within each said longitudinal groove, wherein said shelf is disposed between said sidewalls such that each of said laterally extending projections is disposed within a corresponding longitudinal groove, said shelf movable from said first shelf position wherein each of said laterally extending projections is supported by a corresponding first support and said second shelf position wherein each of said laterally extending projections is supported by a corresponding second support, wherein a rear wall is disposed between said sidewalls, wherein said shelf further comprises a rearwardly extending projection which can flex, and wherein said rear wall comprises an inner surface and a longitudinal groove for receiving said rearwardly extending projection, said groove of said rear wall disposed in said inner surface of said rear wall, wherein said rear wall further comprises a first support for supporting said rear projection in said first shelf position, said first support disposed within said groove of said rear wall, and a second support for supporting said rear projection in said second shelf position, said second support spaced apart from said first support and disposed within said groove of said rear wall, wherein said shelf is disposed between said sidewalls such that said rear projection is disposed in said groove of said rear wall, said shelf movable from said first shelf position wherein said rear projection is supported by said first support and said second shelf position wherein said rear projection is supported by said second support, and wherein when sufficient force is exerted on said shelf, each said support is operable to cause a corresponding said laterally extending projections and said rear projection of said shelf to flex, thereby allowing said shelf to slide past said support and to slide within longitudinal said groove to said second support in said longitudinal groove.

2. The apparatus of claim 1 wherein said rear wall further comprises an aperture for permitting access to a bag supported by said shelf.

3. The apparatus of claim 1 further comprising a first end wall disposed at a first end of said sidewalls, and a second end wall disposed at a second end of said sidewalls.

4. A method for storing fluid containing bags comprising the steps of:

providing a pair of opposed sidewalls;

providing a first shelf between said sidewalls;

supporting said first shelf in a first shelf position orienting said sidewalls such that they extend upwardly in a generally vertical direction such that said shelves are in a generally horizontal orientation;

placing a first fluid containing bag on said first shelf;

freezing said first fluid containing bag;

moving said first shelf to a second shelf position;

supporting said first shelf in said second shelf position;

providing a second shelf between said sidewalls;

supporting said second shelf in said first shelf position;

placing a second fluid containing bag on said second shelf;

freezing said second fluid containing bag;

orienting said sidewalls such that they extend laterally in a generally horizontal direction such that said shelves are in a generally vertical orientation, whereby the shelves are spaced from one another such that when a fluid containing bag is disposed in a gap between two adjacent said shelves, said shelves act to press the fluid containing bag substantially flat;

removing said first fluid containing bag from said first shelf before removing said second fluid containing bag from said second shelf; and each of said first and second shelves further comprises a bag-supporting surface, and a pair of laterally extending projections which can flex; and each sidewall comprising an inner surface, a longitudinal groove for receiving one of said laterally extending projections, and an entrance slot, each entrance slot in communication with a corresponding longitudinal groove of one of said sidewalls, each of said entrance slots operable to permit one of said laterally extending projections to pass into said corresponding longitudinal groove of one of said sidewalls.

5. The method of claim 4 further comprising the step of removing said first shelf from between said sidewalls.

6. The method of claim 5 further comprising the steps of moving said second shelf to said second shelf position, and supporting said second shelf in said second shelf position.

7. The method of claim 6 further comprising the steps of returning said first shelf to between said sidewalls, and supporting said first shelf in said first shelf position.

8. The method of claim 7 further comprising the steps of removing said second fluid containing bag from said second shelf, and removing said second shelf from between said sidewalls.

* * * * *